US008899194B2

(12) United States Patent
Engel

(10) Patent No.: US 8,899,194 B2
(45) Date of Patent: Dec. 2, 2014

(54) TWO-STROKE ENGINE

(75) Inventor: Bernd Engel, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 769 days.

(21) Appl. No.: 12/929,810

(22) Filed: Feb. 17, 2011

(65) Prior Publication Data

US 2011/0197868 A1 Aug. 18, 2011

(30) Foreign Application Priority Data

Feb. 17, 2010 (DE) ..... 10 2010 008 260

(51) Int. Cl.

| | |
|---|---|
| ***F02B 25/00*** | (2006.01) |
| ***F02M 35/10*** | (2006.01) |
| ***F02B 25/24*** | (2006.01) |
| ***F02B 25/22*** | (2006.01) |
| ***F02M 35/108*** | (2006.01) |
| ***F02F 3/24*** | (2006.01) |
| ***F02B 25/18*** | (2006.01) |
| *F02B 75/02* | (2006.01) |

(52) U.S. Cl.

CPC ..... *F02F 3/24* (2013.01); *F02M 35/1019* (2013.01); *F02B 2075/025* (2013.01); *F02B 25/24* (2013.01); *F02B 25/22* (2013.01); *F02M 35/108* (2013.01); *F02M 35/10222* (2013.01); *F02B 25/18* (2013.01)

USPC ..... 123/73 PP; 123/65 P; 123/73 FA; 123/73 AA

(58) Field of Classification Search

USPC ..... 123/73 PP, 65 P, 73 FA, 73 AA

See application file for complete search history.

(56) References Cited

U.S. PATENT DOCUMENTS

| | | | | |
|---|---|---|---|---|
| 1,646,998 | A * | 10/1927 | Gill, Jr | 92/239 |
| 4,195,600 | A * | 4/1980 | Shingai | 123/43 AA |
| 5,979,391 | A * | 11/1999 | Ulrich et al. | 123/193.6 |
| 6,691,650 | B2 | 2/2004 | Zama et al. | |
| 6,895,910 | B2 * | 5/2005 | Geyer et al. | 123/73 PP |
| 6,945,203 | B2 * | 9/2005 | Amend et al. | 123/73 PP |
| 7,025,021 | B1 * | 4/2006 | Andersson et al. | 123/73 PP |
| 7,178,501 | B2 * | 2/2007 | Schmidt et al. | 123/197.1 |
| 8,453,559 | B2 * | 6/2013 | Ohmori et al. | 92/239 |
| 2003/0217709 | A1 * | 11/2003 | Geyer et al. | 123/73 PP |

FOREIGN PATENT DOCUMENTS

| | | |
|---|---|---|
| EP | 0 071 776 A1 | 2/1983 |

* cited by examiner

*Primary Examiner* — Marguerite McMahon
*Assistant Examiner* — James Kim
(74) *Attorney, Agent, or Firm* — Walter Ottesen P.A.

(57) ABSTRACT

A two-stroke engine (1) includes a combustion chamber (3) which is defined by a piston (5, 44) which is mounted in the cylinder (2) to reciprocate. The piston (5, 44) has a first control surface (62) which controls an outlet (9) out of the combustion chamber (3) and two second control surfaces (63) for the transfer windows (11, 13) of at least one transfer channel (10, 12). At least two transfer windows (11, 13) are arranged on opposite sides of the cylinder bore (60). At least a first recess is provided on the piston skirt (36) which extends in the peripheral area between the two second control surfaces (63) and which is separated from the transfer window (11, 13) via a section of the piston skirt (36) in every position of the piston (5, 44).

16 Claims, 9 Drawing Sheets

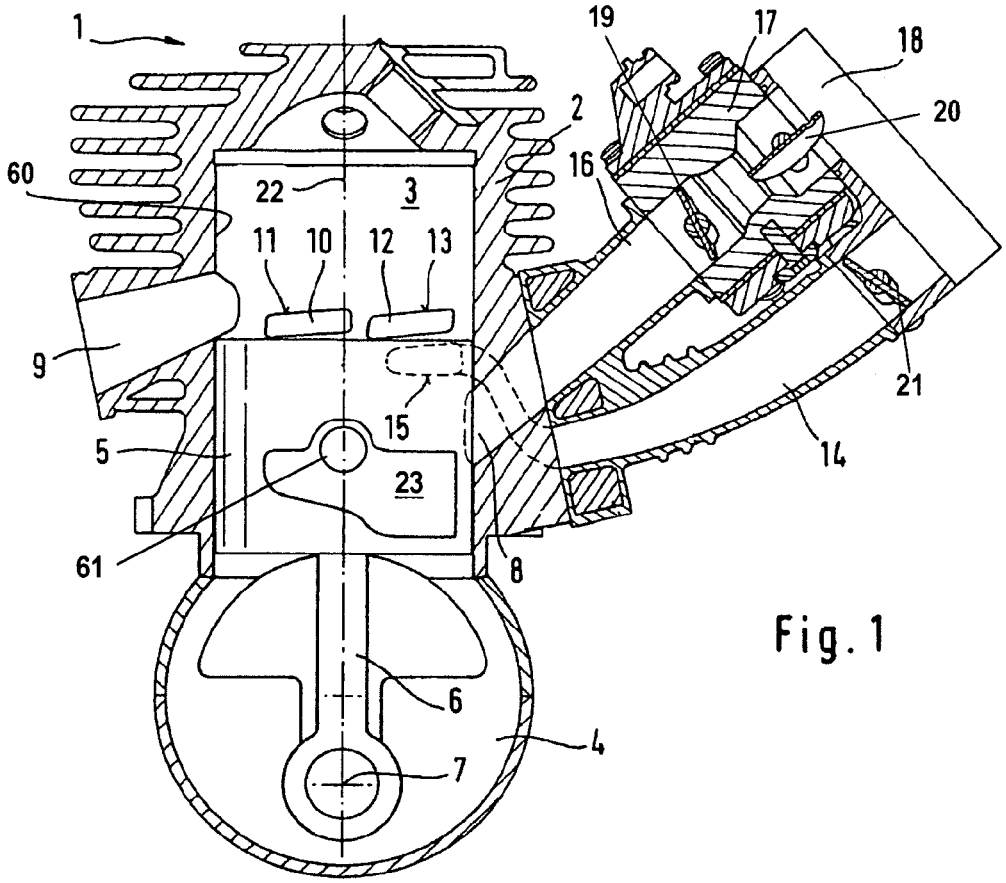
Fig. 1
Fig. 2
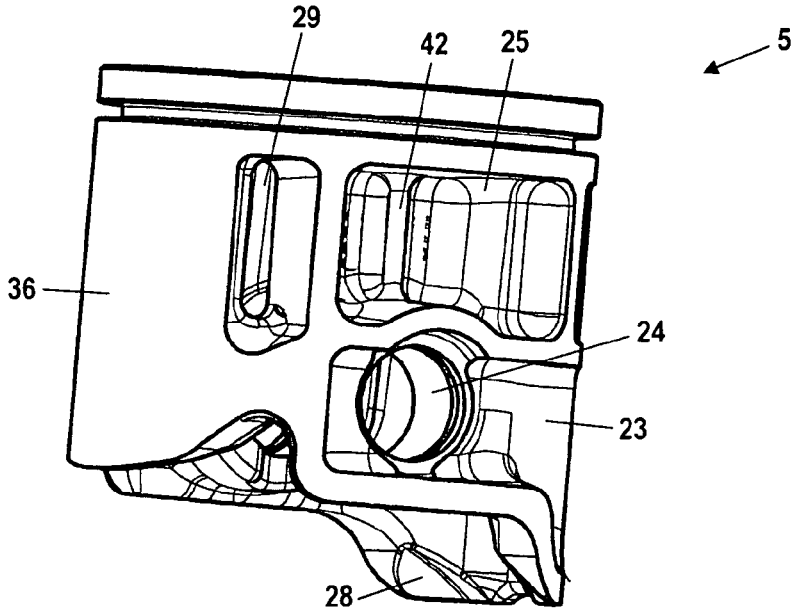

TWO-STROKE ENGINE

CROSS REFERENCE TO RELATED APPLICATION

This application claims priority of German patent application no. 10 2010 008 260.0, filed Feb. 17, 2010, the entire content of which is incorporated herein by reference.

BACKGROUND OF THE INVENTION

U.S. Pat. No. 6,945,203 A1 discloses a two-stroke engine which operates with advanced scavenging. The piston of the two-stroke engine has a piston skirt to connect the air channel with the transfer channels. A small recess for reducing weight is provided above the piston skirt.

It is known to control the mixture inlet into the crankcase, the transfer windows and the outlet of the piston in two-stroke engines as they are for example used in hand-held work apparatus. In engines working with advanced scavenging the connection of the air inlet with the transfer windows is controlled via the piston skirt. Thus, many openings which at fixed predetermined times are to be connected to each other, to the combustion chamber, and/or to the crankcase open at the cylinder bore. For the implementation in a hand-held work apparatus, a two-stroke engine of this type must have a high power-to-weight ratio. High pre-compression of the mixture in the crankcase is desirable in order to achieve high power.

SUMMARY OF THE INVENTION

It is an object of the invention to provide a two-stroke engine of the type mentioned above which has a high power-to-weight ratio.

The two-stroke engine of the invention includes: a cylinder having a cylinder bore; a piston mounted in the cylinder so as to be movable back and forth therein; a combustion chamber delimited by the piston and the combustion chamber having an outlet; a piston pin; a connecting rod connected to the piston by the piston pin; a crankcase; a crank shaft rotatably mounted in the crankcase so as to be driven by the piston via the connecting rod; transfer channel means having at least two transfer windows opening at the cylinder bore and the transfer windows being arranged on opposite sides of the cylinder bore; the crankcase being connected to the combustion chamber and the outlet via the transfer channel means in at least one position of the piston; the piston having a first control surface for the outlet and two second control surfaces for the transfer windows; the piston having a piston skirt; at least one first recess provided at the piston skirt which extends between the two second control surfaces in the peripheral area facing the outlet; and, the first recess being separated from all the transfer windows via a section of the piston skirt in every position of the piston.

The recess on the piston skirt between the two second control surfaces leads to a reduction in the weight of the piston. Since the recess is not connected to the transfer windows in any position of the piston, the control times of the transfer windows are not changed hereby. The total weight of the two-stroke engine can be reduced without affecting the performance as a result of the arrangement of a recess on the piston skirt between both second control surfaces. The two-stroke engine can be designed in such a manner that each transfer channel opens into the combustion chamber with exactly one transfer window. It can, however, be provided that at least one transfer channel splits into two or more branches which open into the combustion chamber with separate transfer windows. In this way, a transfer channel can open into the combustion chamber with a plurality of transfer windows.

Advantageously, the first recess is separated from all openings at the cylinder bore via the piston skirt in every position of the piston. In order to achieve a further reduction in weight, the first recess is configured as a weight-reduction opening which is open to the crankcase. Since the piston is completely recessed at the weight-reduction opening, the weight of the piston is further reduced. The stability of the piston is retained in particular when the piston has a strut between the weight-reduction opening and the lower edge of the piston. It can be provided that a section of the piston skirt is formed on the strut so that the piston is guided on the cylinder bore in this area. It can also be practical, however, that the strut is set back from the piston bore.

In order to achieve an increased precompression, it can, however, be provided that the first recess is configured as a weight-reduction pocket which is closed to the crankcase. The first weight-reduction pocket extends, in particular, into the area of the first control surface. Because the first weight-reduction pocket is closed to the transfer window and the crankcase in every position of the piston, an extension into the area of the first control surface, which effects a connection of the weight-reduction pocket with the outlet, does not change the function of the two-stroke engine. Because the first weight-reduction pocket is closed to the crankcase, the volume of the crankcase is reduced and, thereby, the precompression is increased. To achieve a piston weight as low as possible and a precompression as high as possible, the first weight-reduction pocket extends over the entire width of the first control surface measured in the peripheral direction. In particular, it is provided that on the cylinder bore, at least two transfer windows are arranged on opposing sides of the cylinder bore, that is, on both sides of the outlet. The piston advantageously has two second control surfaces. Each second control surface is arranged in the area of at least one transfer window. The first weight-reduction pocket extends from one second control surface to the other second control surface. The first weight-reduction pocket maintains a distance to the second control surfaces that is required for a sufficient seal to the transfer windows. As a result of this configuration, the first weight-reduction pocket can be configured very large.

Advantageously, the piston has a piston ring groove and a lower edge. The height of the first weight-reduction pocket measured along the longitudinal piston axis is advantageously at every point at least 50% of the distance of the lower edge of the piston from the piston ring groove at this point. A comparatively large distance of the lower edge of the piston to the piston ring groove results in a high tilting stability of the piston. On the basis of the comparatively large height of the first weight-reduction pocket, the volume of the crankcase is considerably reduced by the first weight-reduction pocket.

It is provided that the first weight-reduction pocket projects into the area of the connecting rod. In particular, the first weight-reduction pocket has a base which has an elevation for the connecting rod. Advantageously, the first weight-reduction pocket extends up into the area adjacent to the piston head. The roof of the first weight-reduction pocket extends behind at least one piston ring groove. To ensure sufficient stability of the piston head, at least one reinforcing rib is arranged at the roof of the first weight-reduction pocket. A die-casting manufacture with retractable cores can be achieved when the roof and the base of the first weight-reduction pocket are approximately parallel. In this way, a small opening angle of several degrees, which allows retracting of the core, can be provided between the roof and base.

It is practical that the piston has at least one second recess at the piston skirt which recess forms a second weight-reduction pocket. A mixture inlet opens at the cylinder bore, the piston having a third control surface for the mixture inlet. The second weight-reduction pocket is arranged in particular in the third control surface and is connected exclusively to the mixture inlet during a piston stroke. Fuel which collects at the cylinder bore can be stored intermediately in the second weight-reduction pocket. When pivoting the two-stroke engine, for example when the two-stroke engine is arranged in a hand-held work apparatus, fuel can collect in the intake system. When abruptly entering the crankcase, these fuel accumulations can lead to operational disturbances. This fuel can be intermediately stored in the second weight-reduction pocket. In this way, operational disturbances can be moderated or avoided during pivoting. According to this, the second weight-reduction pocket does not only serve to reduce weight but to avoid operational disturbances.

The two-stroke engine is, in particular, a two-stroke engine working with advanced scavenging. For this purpose, the two-stroke engine has an air channel which opens at the cylinder bore with at least one air inlet. The piston in particular has a piston pocket to connect the air inlet and the transfer windows. Advantageously, at least one third weight-reduction pocket is arranged between the piston pocket and the piston head. In order to achieve an especially large weight reduction and an especially good precompression of the two-stroke engine, it is provided that the third weight-reduction pocket extends over the entire width of the piston and connects one side of the piston above the piston pin with the opposite side. Thus, the precompression can be considerably increased. Advantageously, for separation from the crankcase, the third weight-reduction pocket has a base, which has an elevation or raised portion for the connecting rod. The precompression is greatly increased in that the base extends up into the area of the connecting rod. As a result of the elevation, the movement of the connecting rod can be ensured.

Advantageously, the third weight-reduction pocket has at least one reinforcing rib. In particular, the third weight-reduction pocket is partially connected to the transfer windows during a piston stroke and a fourth weight-reduction pocket is arranged between the piston pocket and the piston head and is partially connected to the air inlet during a piston stroke. A strut is formed on the piston skirt between the third and the fourth weight-reduction pockets. Thus, it is ensured that the transfer window cannot be connected to the air inlet via the third and fourth weight-reduction pockets but exclusively via the piston pocket. Thus, it is ensured that the weight-reduction pockets do not change the control times of the two-stroke engine. The weight-reduction pockets cover the corresponding control surfaces as comprehensively as possible, so that the piston skirt is essentially formed by the struts which separate the individual functional openings from each other during the piston stroke. With these blind pockets, the weight of the piston can be reduced and at the same time the precompression of the two-stroke engine can be increased as a result of the reduced crankcase volume. In addition, the pockets improve the heat transfer from the piston to the surroundings, whereby low compression heights and thus further advantages in terms of constructed space and weight as well as increased precompression can be realized.

BRIEF DESCRIPTION OF THE DRAWINGS

The invention will now be described with reference to the drawings wherein:

FIG. 1 is a schematic section view of a two-stroke engine;

FIG. 2 is a perspective view of an embodiment of a piston;

DESCRIPTION OF THE PREFERRED EMBODIMENTS OF THE INVENTION

Figure 3:
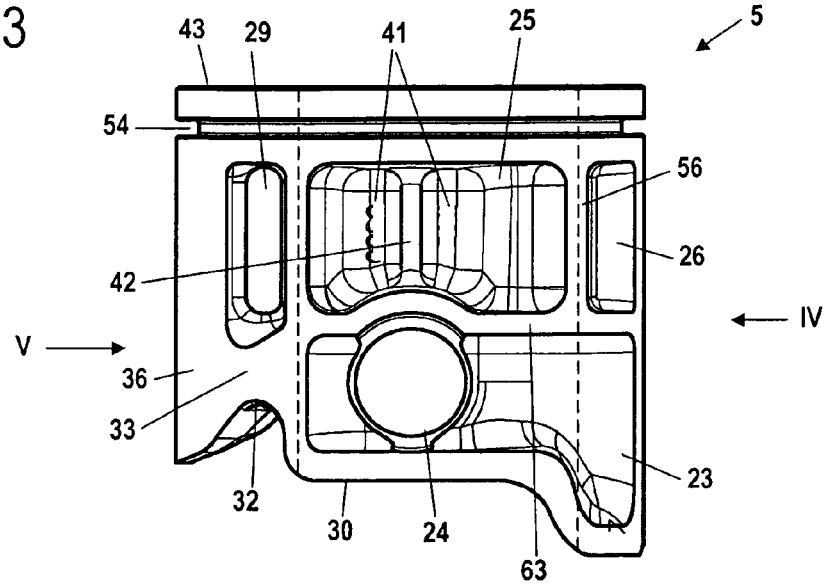
FIG. 3 is a side elevation view of the piston of FIG. 2.
Figure 4:
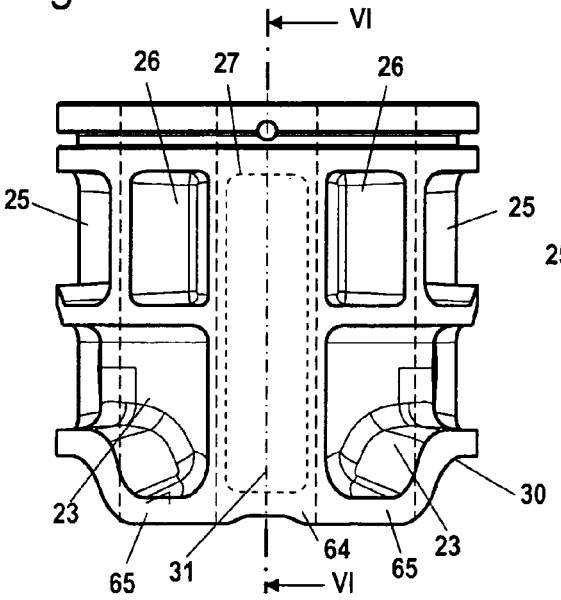
FIG. 4 is a side elevation view in the direction of the arrow IV of FIG. 3.

FIG. 1 shows a one-cylinder two-stroke engine working with advanced scavenging as an example embodiment for a two-stroke engine 1. The two-stroke engine 1 has a cylinder 2 in which a combustion chamber 3 is formed. The combustion chamber 3 is defined by a piston 5 reciprocatingly mounted in the cylinder bore 60 of the cylinder 2. The piston 5 drives a crankshaft 7 rotatably mounted in a crankcase 4 via a connecting rod 6. The piston 5 is connected to the connecting rod 6 via a piston pin 61. A mixture channel 16 opens with a mixture inlet 8 at the cylinder bore 60. In addition, an air channel 14 opens with at least one air inlet 15 at the cylinder bore 60. In the embodiment, the air channel 14 is divided into two branches which open each with an air inlet 15 at the opposite sides of the cylinder bore 60. The second air inlet 15, not shown in FIG. 1, is arranged symmetrically to the sectional plane in FIG. 1.

In the area of bottom dead center of the piston 5 shown in FIG. 1, the crankcase 4 is connected with the combustion chamber 3 via two transfer channels 10 near the outlet and two transfer channels 12 near the inlet. The transfer channels 10 near the outlet are arranged adjacent to the outlet 9 from the combustion chamber 3. The transfer channels 10 near the outlet open with transfer windows 11 at the cylinder bore 60 and the transfer channels 12 near the inlet open with transfer windows 13 at the cylinder bore 60. The air inlet 15 is schematically shown in FIG. 1 and arranged below the transfer window 13. A particularly advantageous configuration of the piston 5 results when the air inlet 15 is shifted in the peripheral direction and arranged adjacent to the transfer window 13.

The air channel 14 and the mixture channel 16 are connected to an air filter 18 via which they draw in combustion air. A section of the mixture channel 16 is guided in a carburetor 17 arranged at the air filter 18. A choke flap 20 and a throttle flap 19 are pivotally mounted in the carburetor 17. The air channel 14 has an air flap 21 to control the amount of air supplied. The piston 5 moves in the direction of the longitudinal axis 22 in the cylinder 2. To connect the air inlet 15 with the transfer windows 11 and 13, the piston 5 has two piston pockets 23 arranged opposite each other.

During operation, air/fuel mixture is drawn into the crankcase 4 via the mixture inlet 8 during the upward stroke of the piston 5. At the same time, air from the air channel 14, which is largely fuel-free, is pre-stored in the transfer channels 10 and 12 via the air inlet 15 and the piston pocket 23. During the downward stroke of the piston 5, the mixture is compressed in the crankcase 4. As soon as the transfer channels 10 and 12 are opened by the piston 5, first pre-stored advanced scavenging air flows into the combustion chamber 3, which air flushes out exhaust gases from the previous engine cycle through the outlet 9. Then, a fresh mixture from the crankcase 4 flows in via the transfer channels 10 and 12. During the upward stroke of the piston 5, first the transfer windows 11 and 13 are closed and subsequently the outlet 9 is closed by the piston 5. In the area of top dead center of the piston 5, the mixture in the combustion chamber 3 is ignited by a spark plug which is not shown. Meanwhile, mixture for the next engine cycle is drawn into the crankcase and advanced scavenging air is pre-stored in the transfer channels 10 and 12. Due to the combustion of the mixture in the combustion chamber 3, the piston 5 is accelerated toward the crankcase 4. Upon opening of the outlet 9 the exhaust gases flow out of the combustion chamber 3 and are flushed out by the advanced scavenging air flowing in via the transfer windows 11 and 13.

Figure 5:
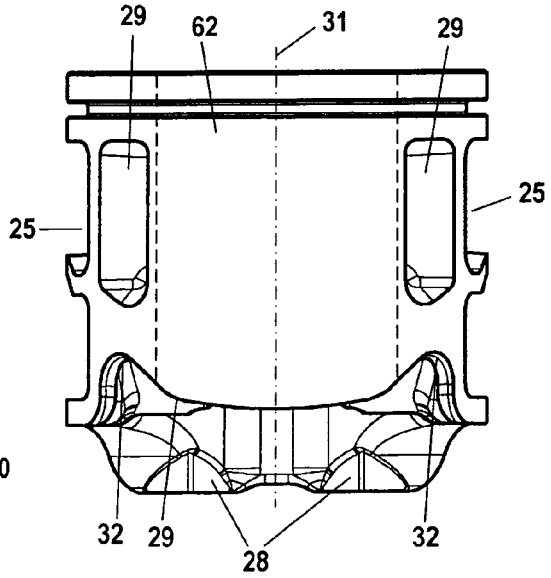
FIG. 5 is a side elevation view in the direction of the arrow V of FIG. 3.

FIG. 2 shows a perspective view of the piston 5 which is shown schematically in FIG. 1. As FIG. 5 shows, the piston 5 has a piston skirt 36 which controls the openings on the cylinder bore 60. To receive the piston pin 61, the piston 5 has a piston pin boss 24 which is arranged in the piston pocket 23. The piston skirt 36 extends down in the direction of the crankcase 4 on the side facing the mixture inlet 8. In this area recesses 28 for the crankshaft 7 are provided on the inner edge of the piston 5, which prevent a collision of the piston 5 with the crankshaft 7 in the area of the bottom dead center of the piston 5.

As FIG. 2 shows, the piston 5 has a weight-reduction pocket 25 above the piston pocket 23 in which a reinforcing rib 42 is arranged. A weight-reduction opening 29 is provided between the piston pocket 23 and the area of the piston skirt 36 facing the outlet 9. The weight-reduction opening 29 connects the outer side of the piston 5 with the piston interior and with the crankcase 4.

As FIG. 3 shows, the piston 5 has a further weight-reduction pocket 26 above the piston pocket 23 between the piston pocket 23 and a piston ring groove 54. The weight-reduction pockets 25 and 26 are separated from each other via a strut 56 on which the piston skirt 36 is formed and in whose area the piston 5 projects up to the cylinder bore 60. As FIG. 3 shows, the lower piston edge 30, which faces the crankcase 4, is designed irregularly. Adjacent to the weight-reduction opening 29, the lower piston edge 30 has a recess 32 at which the lower piston edge 30 is set off in the direction of the piston head 43 and in which the distance of the lower piston edge 30 from the piston head 43 is reduced. A strut 33, on which a section of the piston skirt 36 is formed, is arranged between the weight-reduction opening 29 and the recess 32.

The piston skirt 36 of the piston 5 serves to connect the openings opening at the cylinder bore 60, that is, the mixture inlet 8, the outlet 9, the transfer windows 11 and 13, and the air inlet 15, to each other, to the crankcase 4, or to the combustion chamber 3 at the predetermined control times. For this purpose, the piston 5 has multiple control surfaces on the piston skirt 36 which are shown in FIGS. 3 to 5 and 8. A first control surface 62 is arranged in the area of the outlet 9. The control surface 62 relates to the area between the piston head 43 and the piston's lower edge 30, which is arranged in the peripheral area of the outlet 9, including narrow lateral portions projecting beyond the outlet 9 which seal the outlet 9 in the peripheral direction of the piston. The lateral portions which are necessary for sealing can, for example, be several millimeters wide.

Figure 8:
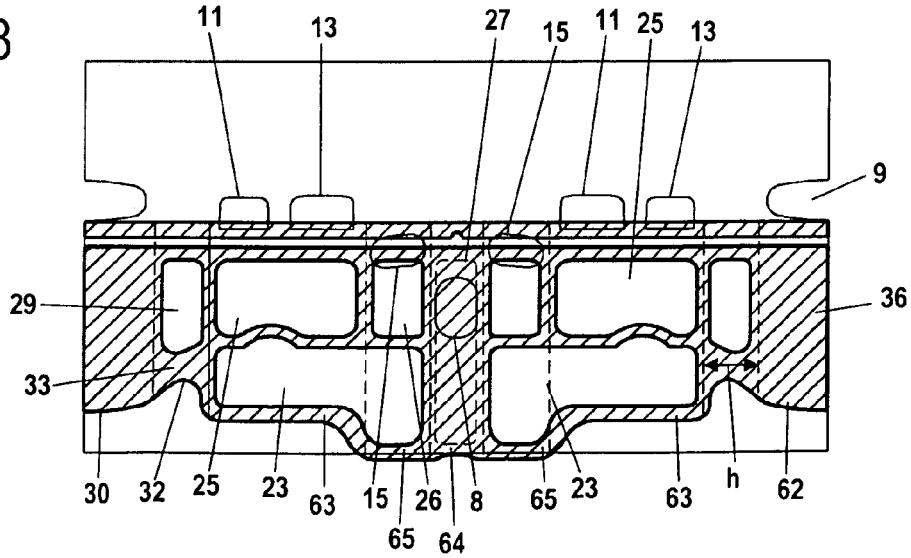
FIG. 8 is a developed view of the cylinder and piston at bottom dead center of the piston.

Second control surfaces 63 extend in the area between the piston head 43 and the piston's lower edge 30 and in the peripheral direction in which the transfer windows 11 and 13 are arranged. The boundaries of the second control surfaces 63 are shown in FIG. 3 by broken lines running parallel to the longitudinal axis of the piston. Multiple recesses, which are described in more detail below, are provided in the control surfaces 63. A distance (h) is formed between the control surfaces 62 and 63 (FIG. 8) and is measured in the peripheral direction. Since the piston 5 is configured in mirror symmetry to the center plane 31 shown in FIGS. 4 and 5, which contains the longitudinal piston axis 35, two second control surfaces 63 and two fourth control surfaces 65 are provided. The center plane 31 of the piston 5 corresponds to the symmetry plane of the cylinder 2. The fourth control surfaces 65 are arranged in the area that controls the air inlet 15. As FIG. 8 shows, the piston pockets 23 extend over the control surfaces 63 and 65 and thus connect the transfer windows 11 and 13 with the air inlet 15. A third control surface 64 controlling the mixture inlet 8 is provided between the two fourth control surfaces 65. As is shown in the FIGS., the weight-reduction pocket 25 extends exclusively in the area of the second control surface 63, the weight-reduction pocket 26 extends exclusively in the area of the fourth control surface 65, and the weight-reduction opening 29 is arranged in the area between the first control surface 62 and the second control surface 63 which have a distance (h) from each other.

As FIGS. 4 to 8 show, a further weight-reduction pocket 27, shown by broken lines in the FIGS., can be arranged in the area of the mixture inlet 8 in the third control surface 64. The weight-reduction pocket 27 serves not only to reduce the weight of the piston 5 but also to intermediately store mixture from the mixture inlet 8 during operation. If the two-stroke engine 1 is used in a hand-held work apparatus such as a motor-driven chain saw, a brush cutter, a cut-off machine, or the like, fuel accumulations can occur in the mixture channel 16 during operation. The fuel accumulations can, for example, result from pressure fluctuations in the mixture channel and/or non-optimum flow speeds and thus non-optimum mixture preparation. This fuel can be intermediately stored in the weight-reduction pocket 27. Thereby, an operating disturbance while idling, resulting from a surge of supplied fuel into the crankcase 4, can be avoided. In two-stroke engines 1, in which the air channel 14 and the mixture channel 16 are not completely separated during operation, mixture can also be intermediately stored in the weight-reduction pockets 26. As in particular FIG. 8 shows, all weight-reduction pockets 25, 26 and 27, and the weight-reduction openings 29 are each surrounded by a section of the piston skirt 36 and are thus sealed against one another. The piston pocket 23 is also surrounded by a corresponding section of the piston skirt 36.

Figure 6:
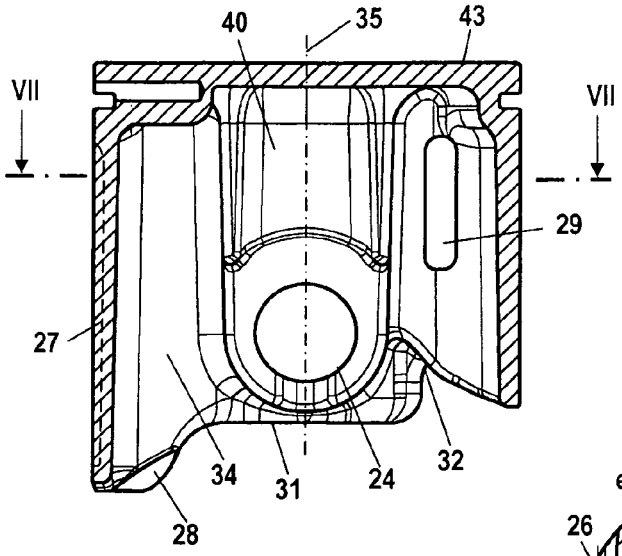
FIG. 6 is a section view along the line VI-VI of FIG. 4.
Figure 7:
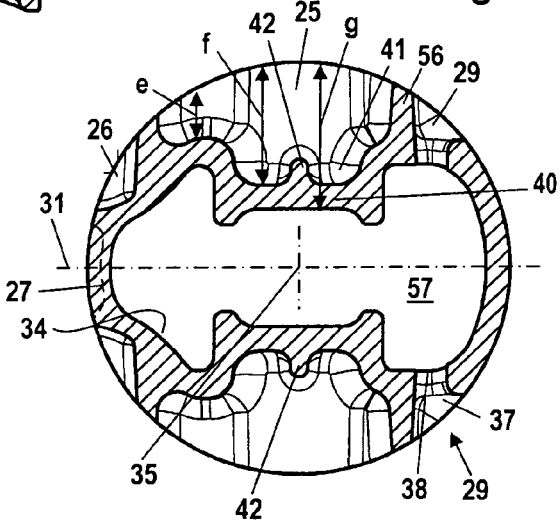
FIG. 7 is a section view along the line VII-VII of FIG. 6.

FIGS. 6 and 7 show the configuration of the weight-reduction pockets 25, 26, and 27, and of the weight reduction opening 29 in detail. The weight-reduction openings 29 each have an approximately funnel-shaped recess 37 which extends in the direction of the longitudinal piston axis 35 and is connected with the piston interior 57 via a slot 38. During operation, the longitudinal piston axis 35 coincides with the longitudinal cylinder axis 22. The weight-reduction pockets 25 and 26 are configured so deep that they are separated from the piston interior 57 by only one wall section. The inner contour 34 of the piston 5 is straight in the upward direction of the piston 5 and approximately parallel to the longitudinal piston axis 35. In order to achieve this, the depth of the weight-reduction pocket 26 approximately corresponds to the depth of the piston pocket 23 in the area lying therebelow.

The weight-reduction pocket 25 has a first depth (e) which approximately corresponds to the depth of the piston pocket 23 in the area lying therebelow. Above the piston pin boss 24, the weight-reduction pocket 25 has a recess 41 having a depth (f). For example, the depth (f) can be approximately twice as large as the depth (e). The reinforcing rib 42, which is also shown in FIG. 3 and is about parallel to the piston's longitudinal rib, is arranged approximately in the middle of recess 41. The recess 41 projects up to a support section 40 which supports the piston pin boss 24 toward the piston head 43. The support section 40 has a distance (g) from the piston skirt 36, which is larger than the depth (f) of the weight-reduction pocket 25 in the recess 41 by the thickness of the piston wall. Due to the resulting straight inner contour 34, the piston 5 can be manufactured in a die-casting process having a core which can be retracted in the direction of the longitudinal piston axis 35. The weight-reduction pockets 25 and 26 and the weight-reduction opening 29 are also arranged in such a manner that they can be molded with cores retracted perpendicularly to the center plane 31 or with mold halves dismantled in this direction. Only the weight-reduction pocket 27 must be manufactured via a further core or in a subsequent machining process. With other piston configurations and engine configurations, other demolding arrangements can be advantageous.

Figure 9:
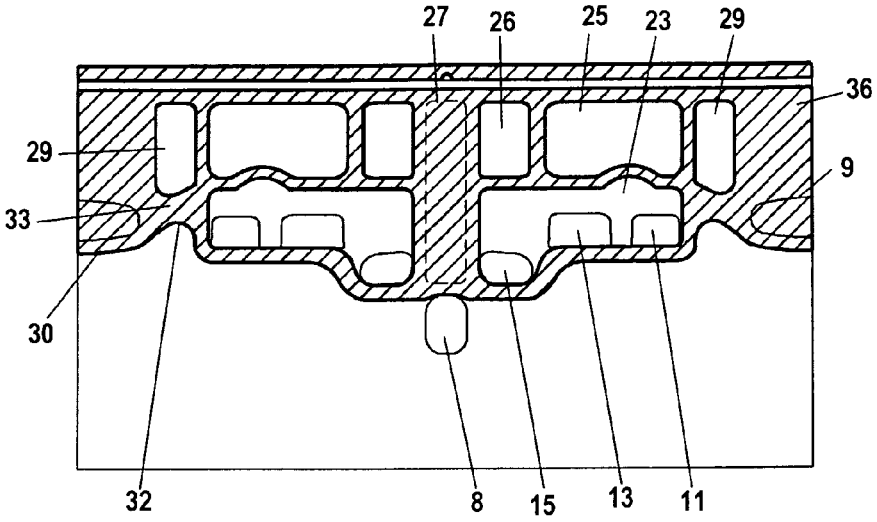
FIG. 9 is a developed view of the cylinder and piston at top dead center of the piston.

FIG. 8 shows the piston 5 at bottom dead center. In this position, the outlet 9 and the transfer windows 11 and 13 are open to the combustion chamber 3. The air inlets 15 are connected to the weight-reduction pockets 26. The mixture inlet 8 is closed or connected with the weight-reduction pocket 27. During the upward stroke of the piston 5, first the transfer windows 11 and 13 are also connected to the weight-reduction pockets 25. In the downward stroke of the piston, first the transfer windows 11 and 13 and subsequently the air inlets 15 open to the piston pockets 23, so that the advanced scavenging air from the air channel 14 can be prestored in the transfer channels 10 and 12. In the area of top dead center, the mixture inlet 8 also opens to the crankcase 4. This position is shown in FIG. 9. Before reaching bottom dead center, the weigh-reduction pocket 27 in the shown configuration is connected to the crankcase 4 via the mixture inlet 8.

Figure 10:
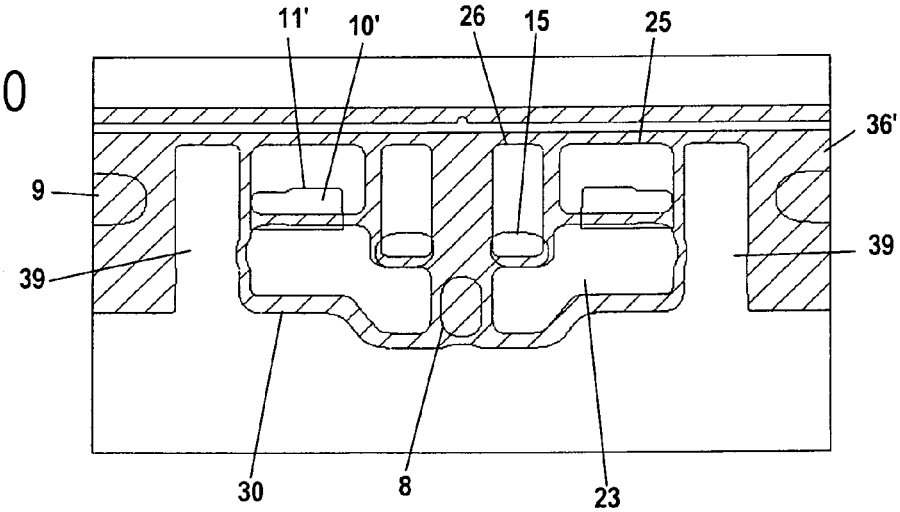
FIG. 10 is a developed view of the cylinder and an embodiment of a piston prior to opening the air inlet.
Figure 11:
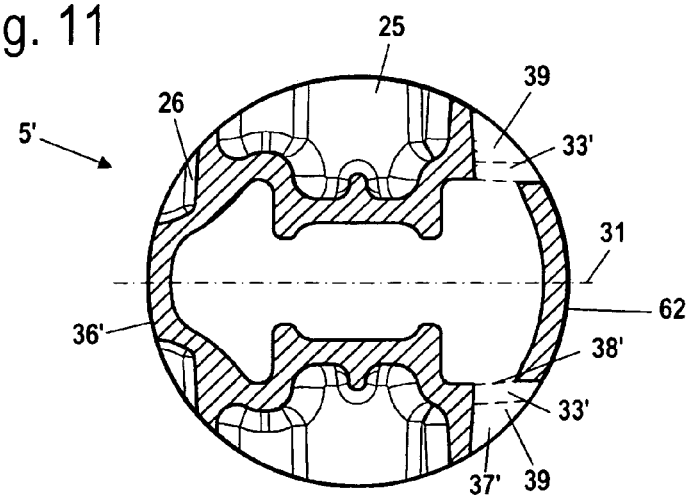
FIG. 11 is a section view through the piston of FIG. 10 at the level of line VII-VII of FIG. 6.

An embodiment of the piston 5' is shown in FIGS. 10 and 11. The piston in FIG. 10 is shown in a position in which the air inlets 15 are opened. The reference numerals correspond to the same parts as in the previous FIGS. The piston 5' has a piston skirt 36'. Only two transfer channels 10' open with transfer windows 11' at the cylinder 2. Further along the upward stroke the transfer windows 11' are connected to the air channel 14 via the piston pocket 23. The piston 5' has weight-reduction openings 39 instead of weight-reduction openings 29. These are shown in detail in FIG. 11. The weight-reduction openings 39 are also formed by a recess 37' which is followed by a slot 38'. However, the weight-reduction openings 39 are not separated from the lower piston edge 30 by a strut 33 but via struts 33' which are distanced to the outer periphery of the piston 5'. In the embodiment, the struts 33' run approximately parallel to the center plane 31. Sufficient guidance of the piston 5' on the cylinder bore 60 is given via the lower piston edge 30 in the area of the first control surface 62. The struts 33' only serve the purpose of mechanical reinforcement.

Figure 12:
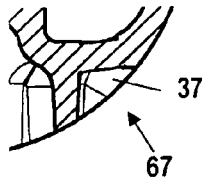
FIG. 12 is a cut-away cross-sectional view of an embodiment of a piston.
Figure 13:
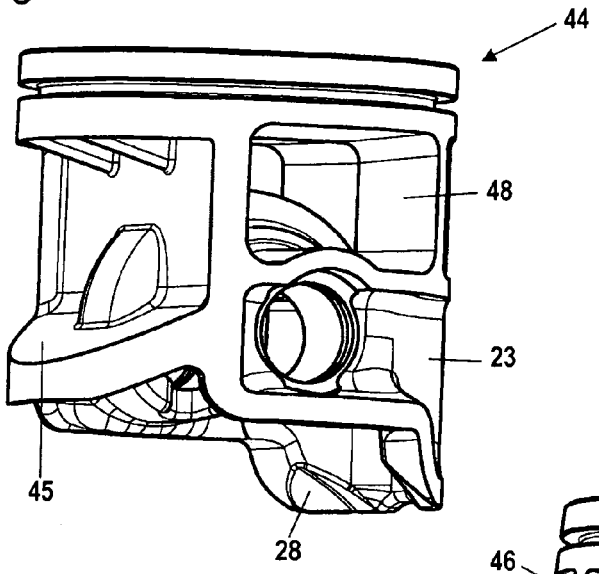
FIG. 13 is a perspective view of an embodiment of a piston.

FIG. 12 is a cut-away view showing an embodiment of a piston in which, at the recesses 37, a weight-reduction pocket 67 that is closed to the crankcase 4 instead of the weight-reduction pocket 62 that is open to the crankcase 4 is provided. The further configuration of the piston corresponds to the piston configurations shown in FIGS. 6 to 11.

Figure 15:
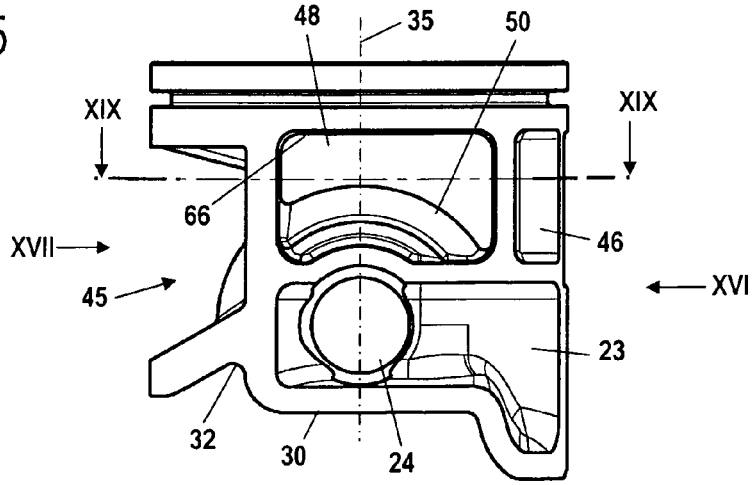
FIG. 15 is a side elevation view of the piston of FIGS. 13 and 14.
Figure 16:
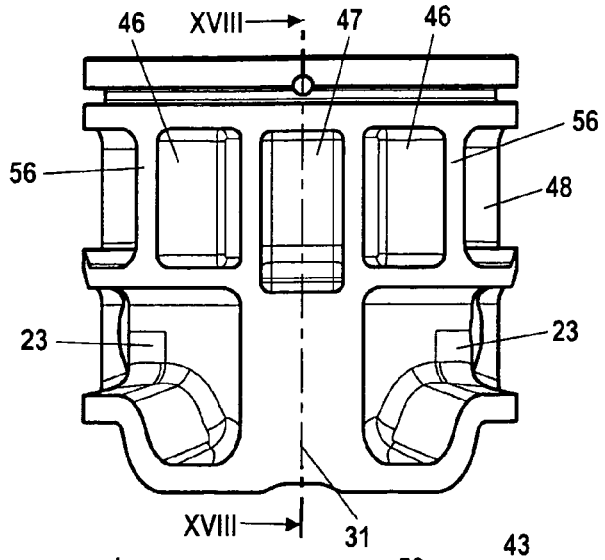
FIG. 16 is a side elevation view in the direction of the arrow XVI of FIG. 15.
Figure 17:
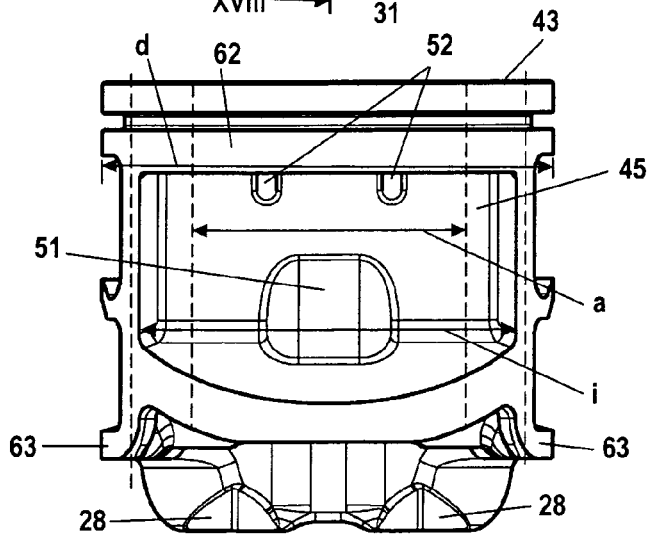
FIG. 17 is a side elevation view in the direction of arrow XVII of FIG. 15.

FIGS. 13 to 19 show an embodiment of a piston 44. The same reference numerals refer to the same parts as in the previous FIGS. The piston 44 has a first weight-reduction pocket 45 which extends in the area of the outlet 9 of the two-stroke engine 1. The weight-reduction pocket 45 extends over the second control surface 63 and over the area between the control surface 62 and up to the control surface 63. As FIG. 17 shows, the second control surface 62 has a width (a), measured in the peripheral direction, which is smaller than the width (i) of the weight reduction pocket 45 which is also measured in the peripheral direction.

Figure 18:
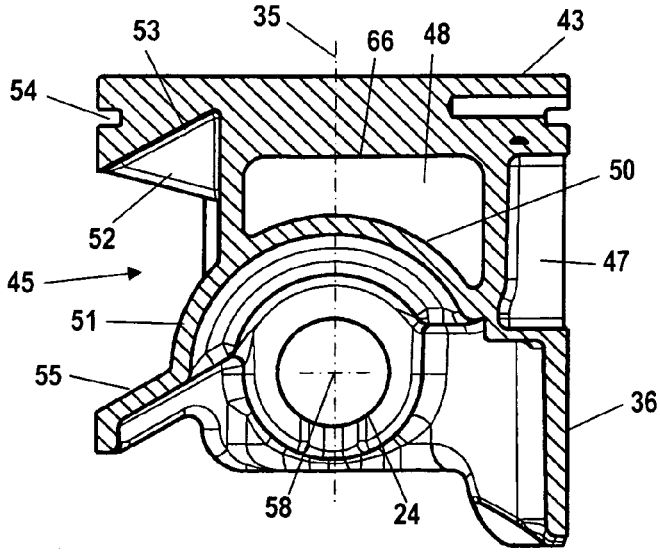
FIG. 18 is a section view along the line XVIII-XVIII of FIG. 16.

The configuration of the weight-reduction pocket 45 in particular is shown in detail in FIG. 18. The weight-reduction pocket 45 has a base 55 which has a raised portion or elevation for the connecting rod 6. The elevation 51 extends in an arch-shaped manner around the longitudinal center axis 58 of the piston pin 61. In the direction of the piston head 43, the weight-reduction pocket 45 has a roof 53 which is inclined toward the longitudinal piston axis 35. Thereby, the distance of the roof 53 to the piston head 43 decreases in the direction of the center of the piston head 43. The roof 53 extends behind the piston ring groove 54 and forms an undercut. The base 55 is inclined accordingly toward the roof 53 and runs parallel thereto, so that the weight-reduction pocket 45 can be demolded with a core which is parallel to the roof 53 and the base 55. Two reinforcing ribs 52, also shown in FIG. 17 and running parallel to the longitudinal piston axis 35, are provided adjacent to the roof 53.

Figure 14:
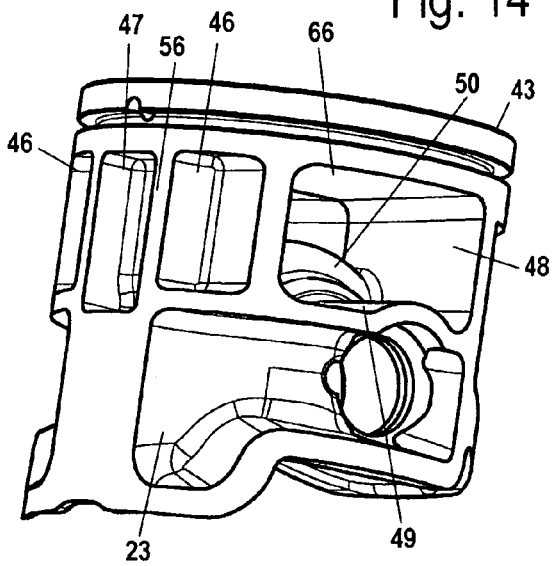
FIG. 14 is a perspective view of an embodiment of a piston.

As shown in FIG. 14, the piston 44 has a weight-reduction pocket 48 between the piston pocket 23 and the piston head 43 which has a base 49 facing the piston pin boss 24. The base 49 has an elevation 50 for the connecting rod 6, which, as shown in FIG. 18, connects to the elevation 51 and likewise runs in an arch-like manner around the longitudinal center axis 58 of the piston pin 61.

Figure 19:
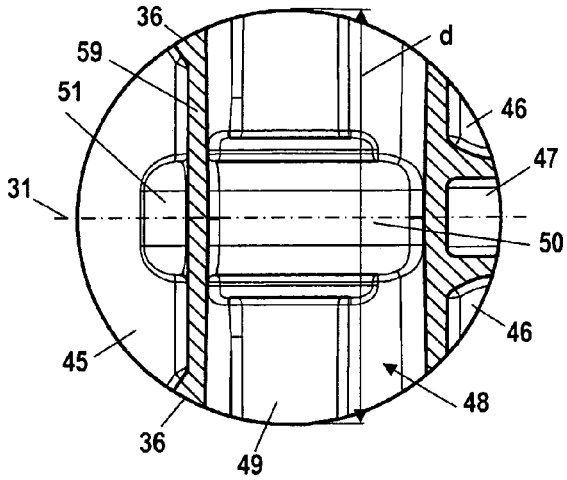
FIG. 19 is a section view along the line XIX-XIX of FIG. 15.

The weight-reduction pocket 48 extends over the entire width (d) of the piston 44 shown in FIG. 17 and connects the opposing piston sides to one another. In this way, the weight of the piston 44 can be considerably reduced. Because the weight-reduction pocket 48 is closed toward the crankcase 4, the volume of the crankcase 4 is smaller. Thus, an increased pre-compression results. FIG. 19 also shows the weight-reduction pocket 48 extending over the entire width (d) of the piston 44. As FIG. 19 shows, the weight-reduction pockets 45 and 48 are connected by an essentially even wall 59 which is parallel to the longitudinal piston axis 35 and perpendicular to the center plane 31. The wall 59 is configured a little bit wider only in the area of the piston skirt 36 in order to ensure good guidance of the piston 44.

As FIGS. 13 to 15 and 18 show, the weight-reduction pocket 48 has a roof 66 which is even and parallel to the piston head 43.

Figure 20:
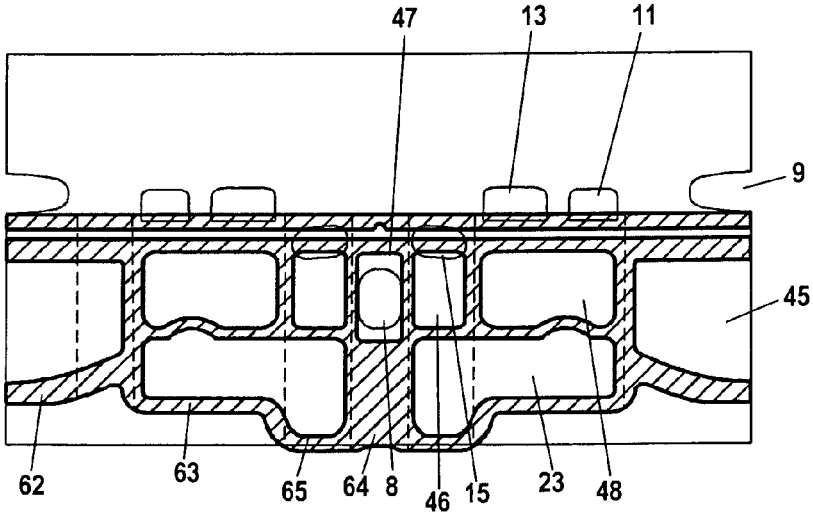
FIG. 20 is a developed view of the cylinder and piston at bottom dead center of the piston.

As FIGS. 14 to 16 show, weight-reduction pockets 46 are arranged each above the piston pockets 23 in the area of the fourth control surfaces 65 (FIG. 20) adjacent the weight-reduction pocket 48. The weight-reduction pockets 46 are separated from the weight-reduction pockets 48 via struts 56. Between the weight-reduction pockets 46, in the area of the third control surface 64, a weight-reduction pocket 47 is arranged, which is connected to the mixture inlet 8 in the area of bottom dead center of the piston 44, as shown in FIG. 20. In the embodiment, the lower edge of the weight-reduction pocket 47 is arranged approximately at the level of the upper edge of the piston pocket 23. Thus, the mixture inlet 8 is connected to either the weight reduction pocket 47 or the crankcase 4, however, never to both at the same time. Between all of the weight-reduction pockets and on the outer periphery of the piston pocket 23 there are arranged respective struts on which the piston skirt 36 projects up to and adjacent the cylinder bore 60 and thus separates the individual pockets and recesses on the piston from one another.

As FIG. 20 shows, the weight-reduction pocket 45 is exclusively connected to the outlet 9. The weight-reduction pocket 48 is exclusively connected to the transfer windows 11 and 13 during a piston stroke. The weight-reduction pocket 46 is exclusively connected to the air inlet 15 and the weight-reduction pocket 47 is exclusively connected to the mixture inlet 8. As the FIGS. show, the piston skirt 36 is covered over almost its entire surface with recesses to the individual openings. The piston skirt 36 is only formed by a grid-like arrangement of struts which separate the individual functional openings from one another.

Figure 21:
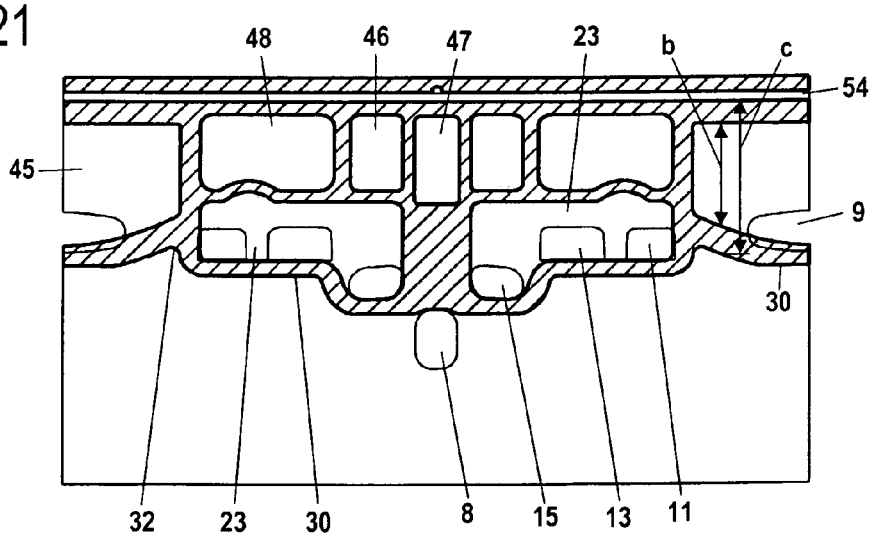
FIG. 21 is a developed view of the cylinder and the piston at top dead center of the piston.
Figure 22:
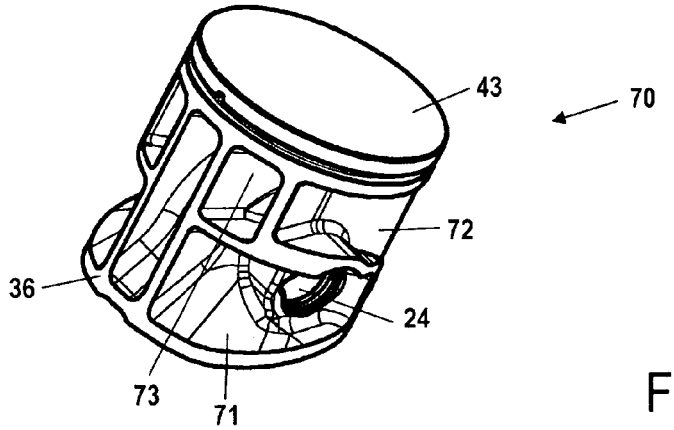
FIG. 22 is a perspective view of a piston.

As FIG. 21 shows, the weight-reduction pocket 45 essentially extends over the entire area between the control surfaces 63, the piston ring groove 54, and the lower piston edge 30. The weight-reduction pocket 45 is separated from the adjacent control surfaces, the piston ring groove 54, and the lower piston edge 30 by small sealing struts only. In every position, the weight-reduction pocket 45 has a height (b) measured parallel to the longitudinal piston axis 35 which amounts to at least 50% of the distance (c) from the lower piston edge 30 and the piston ring groove 54 at this point.

Figure 23:
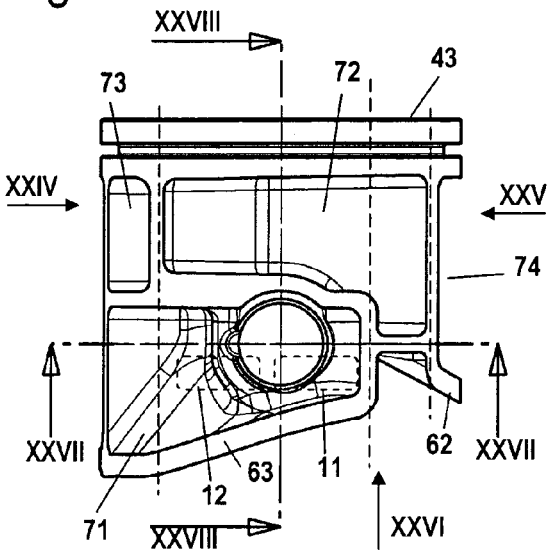
FIG. 23 is a side elevation view of the piston of FIG. 22.
Figure 24:
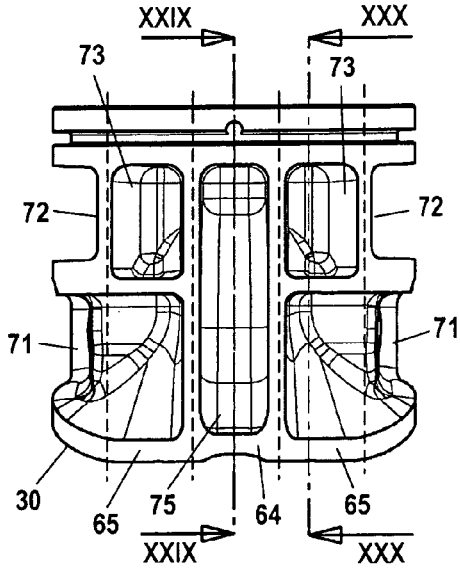
FIG. 24 is a side elevation view in the direction of the arrow XXIV of FIG. 23.

FIGS. 22 to 30 show a piston 70. The same reference numerals refer to corresponding parts as in the previous FIGS. The piston 70 has two piston pockets 71. The piston pin boss 24 is arranged in a piston pocket 71 on each side of the piston. A weight-reduction pocket 72 is arranged above the piston pockets 71, that is, between each of the piston pockets 71 and the piston head 43, a weight-reduction pocket 72 is arranged. The weight-reduction pockets 72 extend beyond the control surfaces 63 and into the area formed between the control surfaces 62 and 63 and up to the control surface 62 controlling the outlet 9. The position of the transfer windows 11 and 13 at top dead center of the piston 70 is schematically shown in FIG. 23. The piston pocket 71 projects in peripheral direction over the area of the transfer windows 11 and 13, which are arranged in the control surface 63, and into the control surface 65 (FIG. 24).

Figure 25:
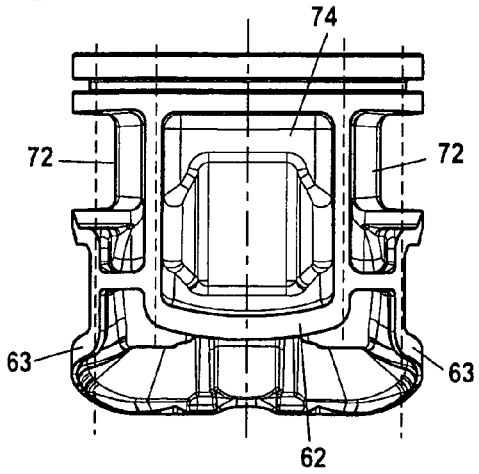
FIG. 25 is a side elevation view in the direction of arrow XXV of FIG. 23.
Figure 26:
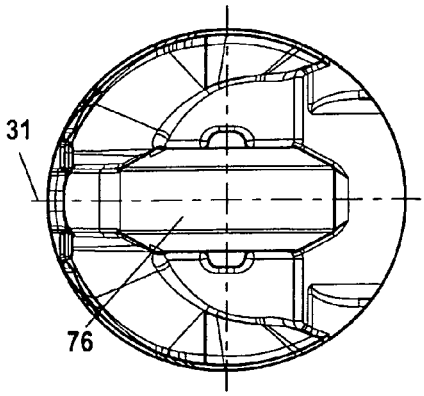
FIG. 26 is a view from below in the direction of arrow XXVI of FIG. 23.
Figure 27:
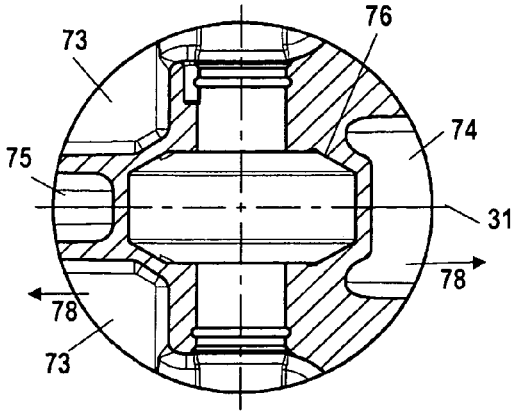
FIG. 27 is a section view along the line XXVII-XXVII of FIG. 23.
Figure 28:
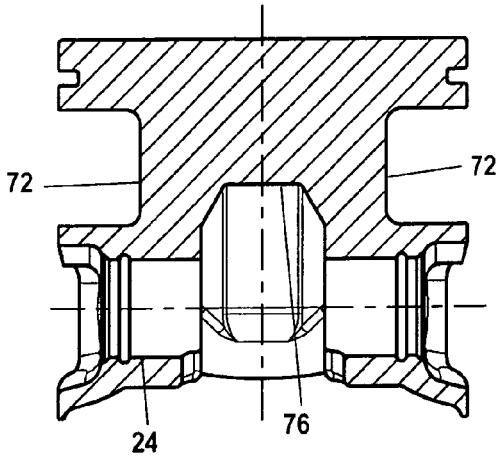
FIG. 28 is a section view along the line XXVIII-XXVIII of FIG. 23.

As FIG. 24 shows, a weight-reduction pocket 73 is arranged in every control surface 65 above a corresponding piston pocket 71. A weight-reduction pocket 75 is arranged in the control surface 64 which controls the mixture inlet 8. As FIG. 25 shows, a weight-reduction pocket 74 is arranged in the control surface 62 which controls the outlet 9. The weight-reduction pockets 72, 73, 74 and 75, and the piston pockets 71 extend over nearly the entire piston skirt, so that the piston skirt is formed only by narrow struts which separate the weight-reduction pockets 72, 73, 74 and 75, and the piston pockets 71 from one another.

As FIGS. 26 to 29 show, the piston 70 has, on its bottom side, a recess 76 for the connecting rod 6. The contour and width of the recess 76 approximately correspond to the contour of the connecting rod 6. The recess 76 surrounds the connecting rod 6 as tightly as possible within the scope of the manufacturing tolerances. In this way, a small volume of the crankcase 4 and thus high precompression of the mixture in the crankcase are achieved.

Figure 29:
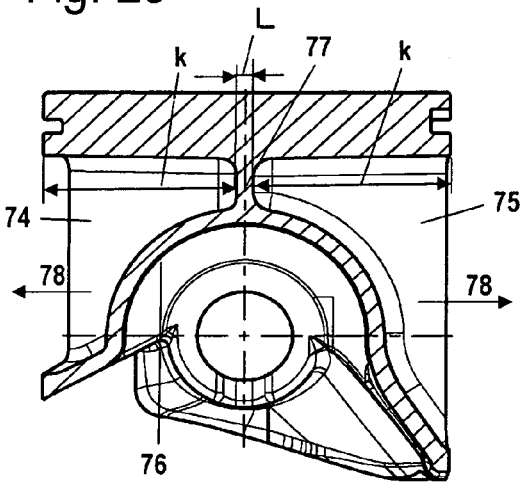
FIG. 29 is a section view along the line XXIX-XXIX of FIG. 24.
Figure 30:
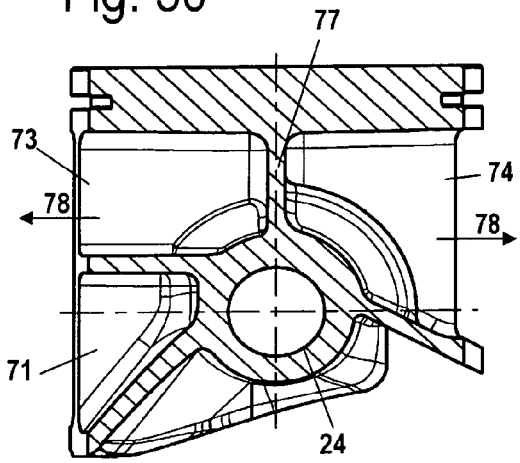
FIG. 30 is a section view along the line XXX-XXX of FIG. 23.

The weight-reduction pockets 72, 73, 74 and 75, and the piston pockets are configured such that the piston 70 with cores retractable in parallel to the center plane 31 can be manufactured in the die-casting method. For this purpose, the weight-reduction pockets 72, 73, 74 and 75, and piston pockets 71 are configured such that no undercuts result in the direction of the arrows 78 shown in FIGS. 27, 29 and 30. As FIGS. 29 and 30 show, the weight-reduction pockets 73 and 74 each extend up into the area above the piston pin boss 24 and are separated from each other by a narrow strut 77 only. The maximum depth (k) of the weight-reduction pockets 73 and 74 corresponds to nearly the radius of the piston 70. The depth (k) is less than the piston radius by approximately half the width (L) of the strut 77. The depth (k) of the weight-reduction pockets 73 and 74 can vary if the strut 77 is not arranged in the center.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder having a cylinder bore;

a piston mounted in said cylinder so as to be movable back and forth therein;

a combustion chamber delimited by said piston and said combustion chamber having an outlet out of said combustion chamber;

a piston pin;

a connecting rod connected to said piston by said piston pin;

a crankcase;

a crank shaft rotatably mounted in said crankcase so as to be driven by said piston via said connecting rod;

transfer channels having respective transfer windows opening at said cylinder bore and said transfer windows being arranged on opposite sides of said cylinder bore;

said crankcase being connected to said combustion chamber and said outlet via said transfer channels in at least one position of said piston;

said piston having a first control surface controlling the connection of said outlet with the combustion chamber and two second control surfaces for corresponding ones of said transfer windows;

an air filter;

an air channel having at least one air inlet opening at said cylinder bore;

said air channel being configured to pass combustion air drawn by suction through said air filter to said air inlet at said cylinder bore;

said piston having a piston pocket interconnecting said air inlet and said transfer windows and said piston pocket being configured to pass said combustion air from said air channel via said transfer windows for pre-storage in said transfer channels;

said piston having a piston skirt;

at least one weight reduction opening provided on said piston skirt and open toward said crankcase;

said weight reduction opening extending between one of said second control surface and said first control surface; and, said weight reduction opening being separated from all openings in said cylinder bore by said piston skirt in every position of said piston.

2. The two-stroke engine of claim 1, wherein said piston has a strut between said weight reduction opening and the lower edge of said piston.

3. The two-stroke engine of claim 2, wherein a section of said piston skirt is formed on said strut.

4. A two-stroke engine comprising:

a cylinder having a cylinder bore;

a piston mounted in said, cylinder so as to be movable back and forth therein;

a combustion chamber delimited by said piston and said combustion chamber having an outlet out of said combustion chamber;

a piston pin;

a connecting rod connected to said piston by said piston pin;

a crankcase;

a crank shaft rotatably mounted in said crankcase so as to be driven by said piston via said connecting rod;

transfer channels having respective transfer windows opening at said cylinder bore and said transfer windows being arranged on opposite sides of said cylinder bore;

said crankcase being connected to said combustion chamber and said outlet via said transfer channels in at least one position of said piston;

said piston having a first control surface for controlling the connection of said outlet with the combustion chamber and having two second control surfaces for corresponding ones of said transfer windows;

said piston having a piston skirt;

at least one first weight reduction pocket provided on said piston skirt and said first weight reduction pocket extending between said two second control surfaces in the peripheral area facing toward said outlet;

said first weight reduction pocket being separated from all of said transfer windows via a section of the piston skirt and closed to said crankcase in every position of said piston; and, said first weight reduction pocket being configured so as to be connected to said outlet in at least one position of said piston.

5. The two-stroke engine of claim 4, wherein said first weight reduction pocket extends in the area of said first control surface.

6. The two-stroke engine of claim 5, wherein said first control surface has a width (a) measured in the peripheral direction; and, said first weight reduction pocket extends over the entire width (a) of said first control surface.

7. The two-stroke engine of claim 5, wherein said first weight reduction pocket extends from one of said second control surfaces to the other of said second control surfaces.

8. The two-stroke engine of claim 4, wherein:

said piston defines a longitudinal axis and has a piston ring groove and a lower piston edge;

said first weight reduction pocket has a height (b) measured in the direction of said longitudinal piston axis; and, said height (b) is at least 50% of a distance (c) of said lower piston edge from said piston ring groove at this location.

9. The two-stroke engine of claim 4, wherein said first weight reduction pocket has a base having a projection for said connecting rod.

10. The two-stroke engine of claim 4, wherein:

said piston has a piston ring groove;

said first weight reduction pocket has a base and a roof having a reinforcing rib thereon;

said roof of said first weight reduction pocket undercuts behind said piston ring groove; and, said roof and said base of said first weight reduction pocket are approximately parallel.

11. The two-stroke engine of claim 1, further comprising:

a mixture inlet opening at said cylinder bore;

said piston having a second weight reduction pocket in said piston skirt;

said piston having a third control surface for said mixture inlet; and, said second weight reduction pocket being arranged in said third control surface and being exclusively connected to said mixture inlet during a piston stroke.

12. The two-stroke engine of claim 1, wherein said piston has a piston head further comprising a third weight reduction pocket arranged between said piston pocket and said piston head.

13. The two-stroke engine of claim 12, wherein:

said piston has a width (d);

said third weight reduction pocket extends over the entire width (d) of said piston and connects a side of said piston above said piston pin with the opposite side of said piston.

14. The two-stroke engine of claim 12, wherein said third weight reduction pocket has a base having a projection for said connecting rod.

15. The two-stroke engine of claim 12, wherein said third weight reduction pocket has at least one reinforcing rib.

16. The two-stroke engine of claim 12, further comprising:

a fourth weight reduction pocket arranged between said piston pocket and said piston head;

said third weight reduction pocket being connected in part to said transfer windows during a piston stroke;

said fourth weight reduction pocket being connected in part to said air inlet during a piston stroke; and, said third weight reduction pocket and said fourth weight reduction pocket being separated by a strut.

* * * * *